US010403222B2

(12) United States Patent
Zhao

(10) Patent No.: US 10,403,222 B2
(45) Date of Patent: Sep. 3, 2019

(54) GATE DRIVER ON ARRAY CIRCUIT HAVING CLOCK-CONTROLLED INVERTER AND LCD PANEL

(71) Applicant: WUHAN CHINA STAR OPTOELECTRONICS TECHNOLOGY CO., LTD., Wuhan, Hubei (CN)

(72) Inventor: Mang Zhao, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 6 days.

(21) Appl. No.: 15/790,006

(22) Filed: Oct. 22, 2017

(65) Prior Publication Data

US 2018/0240432 A1 Aug. 23, 2018

(30) Foreign Application Priority Data

Feb. 20, 2017 (CN) ..... 2017 1 0090435

(51) Int. Cl.
*G09G 3/36* (2006.01)

(52) U.S. Cl.
CPC ... *G09G 3/3677* (2013.01); *G09G 2300/0408* (2013.01); *G09G 2300/0426* (2013.01); *G09G 2310/0205* (2013.01); *G09G 2310/0283* (2013.01); *G09G 2310/0286* (2013.01); *G09G 2310/0291* (2013.01); *G09G 2310/062* (2013.01); *G09G 2310/08* (2013.01)

(58) Field of Classification Search
CPC ... G09G 2300/0408; G09G 2300/0426; G09G 2310/0205; G09G 2310/0283; G09G 2310/0286; G09G 2310/0291; G09G 2310/062; G09G 2310/08; G09G 3/3677
See application file for complete search history.

(56) References Cited

U.S. PATENT DOCUMENTS

| | | | | |
|---|---|---|---|---|
| 8,107,586 | B2 * | 1/2012 | Shin | G09G 3/3677 377/64 |
| 2004/0164301 | A1 | 8/2004 | Suzuki et al. | |
| 2005/0083319 | A1 * | 4/2005 | Kodate | G09G 3/3659 345/204 |
| 2005/0088105 | A1 | 4/2005 | Tajiri | |

(Continued)

FOREIGN PATENT DOCUMENTS

| | | | |
|---|---|---|---|
| CN | 1523554 | A | 8/2004 |
| CN | 1591148 | A | 3/2005 |

(Continued)

*Primary Examiner* — Ram A Mistry
(74) *Attorney, Agent, or Firm* — Mark M. Friedman

(57) ABSTRACT

A gate driver on array (GOA) circuit includes a plurality of stages of GOA units cascaded. A first control latch module, a signal processing module, and a second control latch module of an Nth stage GOA unit generate an Nth stage dipulse gate driving signal and an Nth stage cascade signal according to clock signals, and an (N−2)th or (N+2)th stage cascade signal. For the clock signals corresponding to adjacent two stages of the GOA units, a first clock signal is delayed for a predetermined period of time with respect to a second clock signal. The two dipulse gate driving signals generated by the adjacent two stages of the GOA units partially overlap.

13 Claims, 6 Drawing Sheets

(56) References Cited

U.S. PATENT DOCUMENTS

| | | | | |
|---|---|---|---|---|
| 2005/0134545 | A1 | 6/2005 | Jang et al. | |
| 2007/0001991 | A1* | 1/2007 | Jang | G09G 3/3677 345/100 |
| 2008/0143759 | A1* | 6/2008 | Chien | G09G 3/3674 345/698 |
| 2009/0002301 | A1 | 1/2009 | Koo et al. | |
| 2009/0079715 | A1 | 3/2009 | Kim | |

FOREIGN PATENT DOCUMENTS

| | | | |
|---|---|---|---|
| CN | 1629925 | A | 6/2005 |
| CN | 101393718 | A | 3/2009 |
| KR | 20150077809 | A | 7/2015 |

* cited by examiner

GATE DRIVER ON ARRAY CIRCUIT HAVING CLOCK-CONTROLLED INVERTER AND LCD PANEL

BACKGROUND OF THE INVENTION

1. Field of the Invention

The present disclosure relates to the field of liquid crystal displays, and more particularly to a gate driver on array (GOA) circuit and a liquid crystal display (LCD) panel.

2. Description of the Prior Art

A liquid crystal display (LCD) panel includes a plurality of data lines, a plurality of scan lines, sub-pixels defined by the data lines crossing the scan lines, and a gate driver on array (GOA) circuit driving the sub-pixels. In order to save space of the LCD panel, save manufacturing cost, and improve productivity, adjacent two sub-pixels on a same line share a same data line by connecting two thin film transistors (TFTs), and the adjacent two sub-pixels are connected with two different scan lines, respectively.

In order to drive the above LCD panel, a gate driving signal of each scan line in the GOA circuit needs to comprise two pulse signals, and gate driving signals of upper and lower stage scan line needs to match and use each other to charge the sub-pixels on the same line.

Therefore, it is necessary to provide a GOA circuit to driving the above LCD panel.

SUMMARY OF THE INVENTION

The aim of the present disclosure is to provide a gate driver on array (GOA) circuit and a liquid crystal display (LCD) panel capable of generating dipulse gate driving signal to drive the LCD panel.

The present disclosure provides the GOA circuit, where the GOA circuit comprises: a plurality of stages of GOA units cascaded, where odd stages of the GOA units are cascaded, and even-stages of the GOA units are cascaded. An Nth stage GOA unit comprises a first control latch module, a signal processing module, a second control latch module, and N is a positive integer.

The first control latch module is electrically connected with the second control latch module and the signal processing module. The first control latch module, the signal processing module, and the second control latch module generate an Nth stage dipulse gate driving signal and an Nth stage cascade signal according to clock signals, and an (N−2)th or (N+2)th stage cascade signal.

For clock signals corresponding to adjacent two stages of the GOA units, a first clock signal is delayed a predetermined period of predetermined period of time with respect to a second clock signal, and two dipulse gate driving signals generated by the adjacent two stages of the GOA units partially overlap. The clock signal comprises a first clock signal, a second clock signal, and a third clock signal.

In the GOA circuit of the present disclosure, the dipulse gate driving signal comprises a first pulse driving signal and a second pulse driving signal. A pulse width of the second pulse driving signal is twice as much as a pulse width of the first pulse driving signal.

In the GOA circuit of the present disclosure, clock pulse widths of the first clock signal, the second clock signal, and the third clock signal are all same. The predetermined period of time is twice as much as the clock pulse width, and the first pulse driving signal of a first dipulse gate driving signal and the second pulse driving signal of a second dipulse gate driving signal are simultaneously generated in the two dipulse gate driving signals generated by the adjacent two stages of the GOA units.

In the GOA circuit of the present disclosure, the first control latch module comprises a first clock-controlled inverter, a second clock-controlled inverter, and a first inverter.

The (N−2)th or (N+2)th stage cascade signal is input to an input end of the first clock-controlled inverter, an output end of the first clock-controlled inverter is electrically connected with an output end of the second clock-controlled inverter and an input end of the first inverter, and the first clock signal and an inverted first clock signal are input to a first control end and a second control end of the first clock-controlled inverter, respectively.

An input end of the second clock-controlled inverter is electrically connected with an output end of the first inverter, and the second control latch module is electrically connected with the signal processing module. The inverted first clock signal and the first clock signal are input to a first control end and a second control end of the second clock-controlled inverter, respectively.

In the GOA circuit of the present disclosure, the second control latch module comprises a third clock-controlled inverter, a fourth clock-controlled inverter and a second inverter.

An input end of the third clock-controlled inverter is electrically connected with an input end of the second clock-controlled inverter, an output end of the third clock-controlled inverter is electrically connected with an output end of the fourth clock-controlled inverter and an input end of the second inverter, and a third clock signal and an inverted third clock signal are input to a first control end and a second control end of the third clock-controlled inverter, respectively.

An input end of the fourth clock-controlled inverter is electrically connected with an output end of the second inverter to output the Nth stage cascade signal, and the inverted third clock signal and the third clock signal are input to a first control end and a second control end of the fourth clock-controlled inverter, respectively.

In the GOA circuit of the present disclosure, the signal processing module comprises a first N-type thin film transistor (TFT), a second N-type TFT, a third N-type TFT, a first P-type TFT, a second P-type TFT, a third P-type TFT, and a third inverter.

A gate electrode of the first N-type TFT and a gate electrode of the first P-type TFT are both electrically connected with the input end of the second clock-controlled inverter. A constant voltage low level signal is input to a source electrode the first N-type TFT by the second N-type TFT, and the constant voltage low level signal VGL is input to a drain electrode of the first N-type TFT by the third N-type TFT. A source electrode of the first N-type TFT outputs the Nth stage dipulse gate driving signal.

A constant voltage low level signal is input to a source electrode of the first P-type TFT and a source electrode of the second P-type TFT by the third P-type TFT. A drain electrode of the first P-type TFT and a drain electrode of the second P-type TFT are both electrically connected with the source electrode of the first N-type TFT.

A gate electrode of the third N-type TFT and a gate electrode of the second P-type TFT are both electrically connected with an output end of the third inverter. The second clock signal is input to an input end of the third inverter, and a gate electrode of the second N-type TFT is electrically connected with a gate electrode of the third P-type TFT to input a gate control signal (Gas signal).

In the GOA circuit of the present disclosure, the Nth stage GOA unit further comprises an output buffer module. An input end of the output buffer module is electrically connected with the source electrode of the first N-type TFT, and an output end of the output buffer module is electrically connected with the Nth stage scan line to output the Nth stage dipulse gate driving signal to the Nth stage scan line.

In the GOA circuit of the present disclosure, the Nth stage GOA unit further comprises a forward and reverse scan control module. The forward and reverse scan control module is electrically connected with the first control latch module to control the (N−2)th or (N+2)th stage cascade signal to input to the first control latch module.

In the GOA circuit of the present disclosure, the GOA unit further comprises a first reset module and a second reset module. The first reset module is electrically connected with the first control latch module to reset the first control latch module; the second reset module is electrically connected with the second control latch module to reset the second control latch module.

The present disclosure further provides the LCD panel, where the LCD panel comprises a plurality of scan lines, a plurality of data lines, a plurality of sub-pixel units defined by the plurality of the scan lines crossing the plurality of the data lines, and a gate driver on array (GOA) circuit providing dipulse gate driving signal for the scan lines. The GOA circuit comprises the GOA circuit of the claim 1; the sub-pixel unit comprises a first sub-pixel and a second sub-pixel; the first sub-pixel and the second sub-pixel are charged by same data line under controlling of the dipulse gate driving signal in the adjacent two stages of the scan line.

The present disclosure provides the GOA circuit and the LCD panel. In the GOA circuit, the first control latch module, the signal processing module, and the second control latch module of the Nth stage GOA unit generate the Nth stage dipulse gate driving signal and the Nth stage cascade signal according to clock signals, and the (N−2)th or (N+2)th stage cascade signal. Two dipulse gate driving signals generated by the adjacent two stages of the GOA units partially overlap. The dipulse gate driving signals are input to the adjacent two stages of the scan line in sequence to simultaneously turn on two TFTs of the adjacent two sub-pixels, and the two sub-pixels are charged by one data line.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "inside", "outside", "side" etc., are only used with reference to the orientation of the accompanying drawings. Therefore, the used directional terms are intended to illustrate, but not to limit, the present invention.

As shown in FIG. 1 to FIG. 6, components having similar structures are denoted by same numerals.

Figure 1:
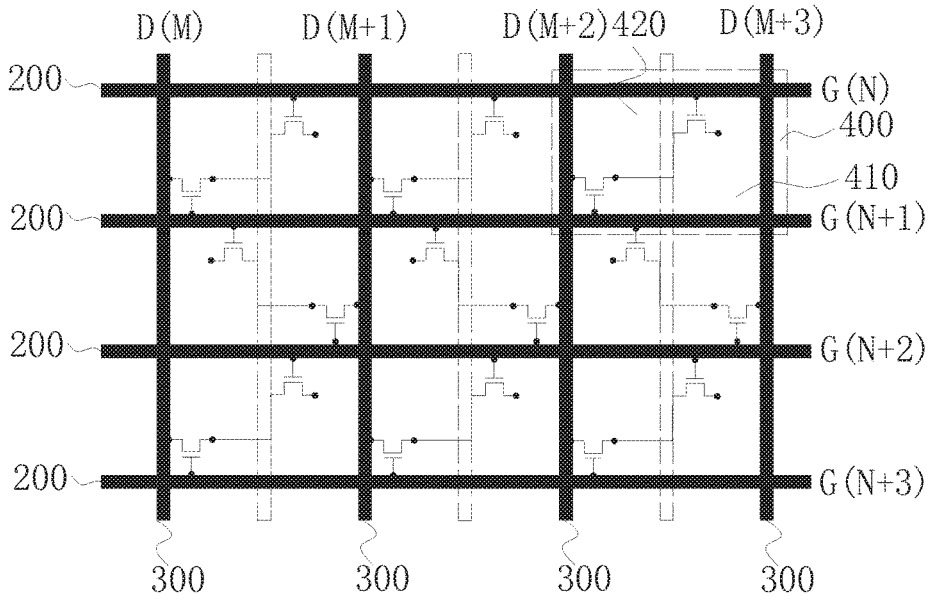
FIG. 1 is a structural diagram of a liquid crystal display (LCD) panel according to an embodiment of the present disclosure.
Figure 2:
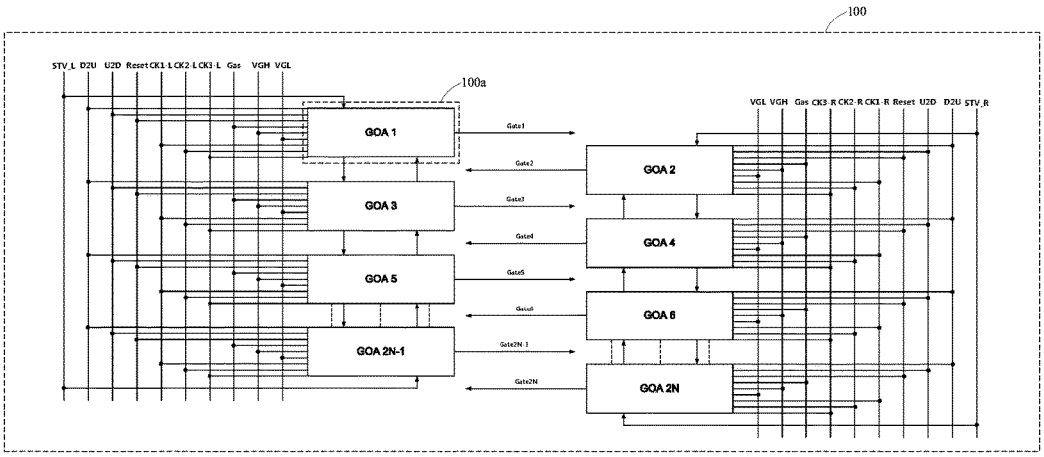
FIG. 2 is a cascaded structural diagram of a gate driver on array (GOA) circuit according to the embodiment of the present disclosure.
Figure 3:
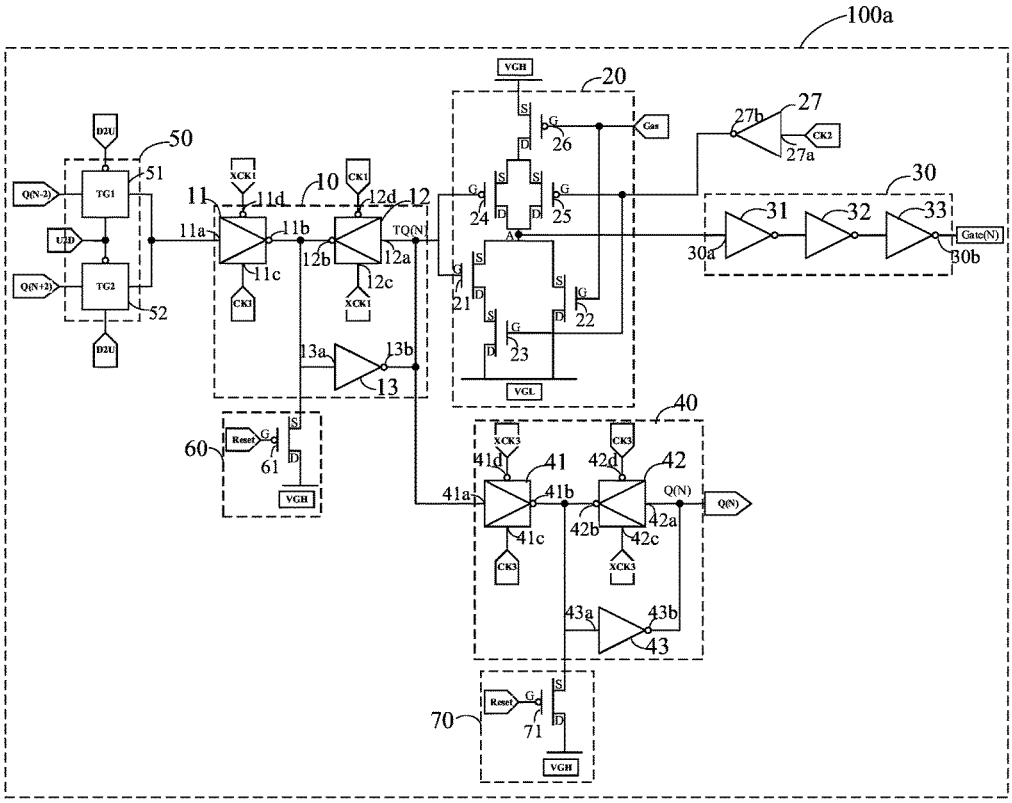
FIG. 3 is a structural diagram of GOA units in the GOA circuit as shown in the FIG. 2.

As shown in FIG. 1 to FIG. 3, FIG. 1 is a structural diagram of a liquid crystal display (LCD) panel according to an embodiment of the present disclosure. FIG. 2 is a cascaded structural diagram of a gate driver on array (GOA) circuit according to the embodiment of the present disclosure. FIG. 3 is a structural diagram of GOA units in the GOA circuit as shown in the FIG. 2.

The present disclosure provides the LCD panel, where the LCD panel comprises the GOA circuit 100, a plurality of scan lines 200, a plurality of data lines 300, and a plurality of sub-pixels units 400 defined by a plurality of the scan lines 200 crossing the plurality of the data lines 300.

In the embodiment, the sub-pixels unit 400 comprises a first sub-pixel 410 and a second sub-pixel 420. The first sub-pixel 410 and the second sub-pixel 420 both comprise thin film transistors (TFTs).

A source electrode of the TFT of the first sub-pixel 410 is corresponding electrically connected with a pixel electrode, a drain electrode of the TFT of the first sub-pixel 410 is electrically connected with a source electrode of the TFT of the second sub-pixel 420, and a gate electrode of the TFT of the first sub-pixel 410 is electrically connected with an Nth stage scan line G(N) 200.

The source electrode of the TFT of the second sub-pixel 420 is corresponding electrically connected with a pixel electrode, a drain electrode of the TFT of the second sub-pixel 420 is electrically connected with an (M+2)th data line D(M+2) 300, and a gate electrode of the TFT of the second sub-pixel 420 is electrically connected with an (N+1)th stage scan line G(N+1) 200.

As shown in FIG. 1, adjacent two sub-pixel units 400 on a same line share different data lines 300 to charge. In addition, according to the description of the above sub-pixel unit 400, in the same line, one data line 300 is arranged on the every adjacent two sub-pixel units. Compared with arrangement of conventional sub-pixels, a number of the data lines of the present disclosure is greatly reduced. A position of vertical imaginary line as shown in FIG. 1 is used to save position of the data lines 300.

In the LCD panel as shown in FIG. 1, each sub-pixel unit 400 is electrically connected with two stages of the scan lines 200, and two sub-pixels of each sub-pixel unit 400 share the same data line 300. Thus, the GOA circuit outputs dipulse gate driving signals to the scan lines 200, and two dipluse gate driving signals corresponding to adjacent two stages of the scan lines 200 need to partially overlap, therefore, each sub-pixel unit 400 as shown in FIG. 1 is charged by one data line 300.

As shown in FIG. 2, FIG. 2 is a cascaded structural diagram of the GOA circuit according to the embodiment of the present disclosure. The GOA circuit 100 in the embodiment comprises a plurality of stages of GOA units cascaded 100*a*, where odd stages of the GOA units 100*a* are cascaded, and even stages of the GOA units 100*a* are cascaded.

The odd stages of the GOA units 100*a* are located on a left-side of the scan lines 200, and the even stages of the GOA units 100*a* are located on a right-side of the scan lines 200. As shown in FIG. 2, the odd stages of the GOA units 100*a* and the even stages of the GOA units 100*a* both need three clock signal lines, a signal line STV, a control line U2D, a control line D2U, a reset signal line Reset, a gate control signal line (Gas), a constant voltage high level signal line VGH and a constant voltage low level signal line VGL, where the three clock signal lines respectively output a first clock signal CK1, a second clock signal CK2, and a third clock signal CK3.

As shown in FIG. 3, FIG. 3 is a structural diagram of GOA units in the GOA circuit as shown in the FIG. 2, the Nth stage GOA unit 100*a* comprises a first control latch module 10, a signal processing module 20, and a second control latch module 40, where N is a positive integer.

In the embodiment, the first control latch module 10 is electrically connected with the second control latch module 40 and the signal processing module 20. The first control latch module 10, the signal processing module 20, and the second control latch module 40 are used to generate an Nth stage dipulse gate driving signal and an Nth stage cascade signal according to clock signals, and an (N−2)th or (N+2)th stage cascade signal.

To be specific, the first control latch module 10 comprises a first clock-controlled inverter 11, a second clock-controlled inverter 12, and a first inverter 13.

Figure 4:
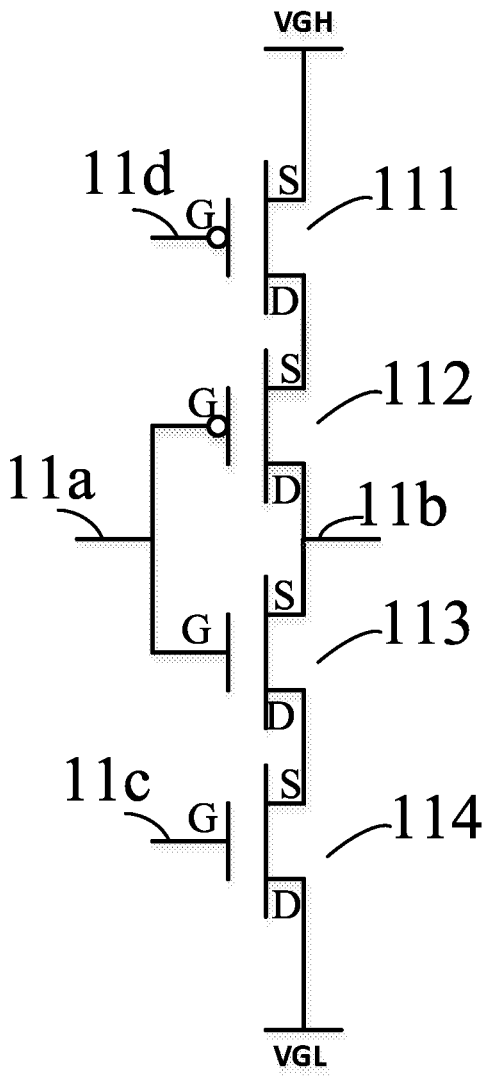
FIG. 4 is an equivalent circuit diagram of a first clock-controlled inverter in a first control latch module as shown in the FIG. 3.

As shown in FIG. 4, FIG. 4 is an equivalent circuit diagram of the first clock-controlled inverter in the first control latch module as shown in the FIG. 3. The first clock-controlled inverter 11 comprises a eighth P-type TFT 111, a ninth P-type TFT 112, a sixth N-type TFT 113, and a seventh N-type TFT 114.

A gate electrode of the ninth P-type TFT 112 is connected with a gate electrode of the sixth N-type TFT 113 to be regarded as an input end 11*a* of the first clock-controlled inverter 11. A drain electrode of the ninth P-type TFT 112 is connected with a source electrode of the sixth N-type TFT 113 to be regarded as an output end 11*b* of the first clock-controlled inverter 11. A constant voltage high level signal (VGH) is input to a source electrode of the ninth P-type TFT 112 by the eighth P-type TFT 111. A constant voltage low level signal (VGL) is input to a drain electrode of the sixth N-type TFT 113 by the seventh N-type TFT 114, a gate electrode of the eighth P-type TFT 111 is regarded as a second control end 11*d* of the first clock-controlled inverter 11, and a gate electrode of the seventh N-type TFT 114 is regarded as a first control end 11*c* of the first clock-controlled inverter 11.

It should be understood that structure of other clock-controlled inverters of the embodiment are the same as the structure of the first clock-controlled inverter 11, and equivalent circuit diagram of other clock-controlled inverters of the embodiment are the same as the equivalent circuit diagram of the FIG. 4.

The (N−2)th or (N+2)th stage cascade signal Q(N−2) or Q(N+2) is input to the input end 11*a* of the first clock-controlled inverter 11, the output end 11*b* of the first clock-controlled inverter 11 is electrically connected with an output end 12*b* of the second clock-controlled inverter 12 and an input end 13*a* of the first inverter 13, and the first clock signal CK1 and an inverted first clock signal XCK1 are input to the first control end 11*c* and the second control end 11*d* of the first clock-controlled inverter 11, respectively.

An input end 12*a* of the second clock-controlled inverter 12 is electrically connected with an output end 13*b* of the first inverter 13, the second control latch module 40 is electrically connected with the signal processing module 20. The inverted first clock signal XCK1 and the first clock signal CK1 are input to a first control end 12*c* and a second control end 12*d* of the second clock-controlled inverter 12, respectively.

Figure 5:
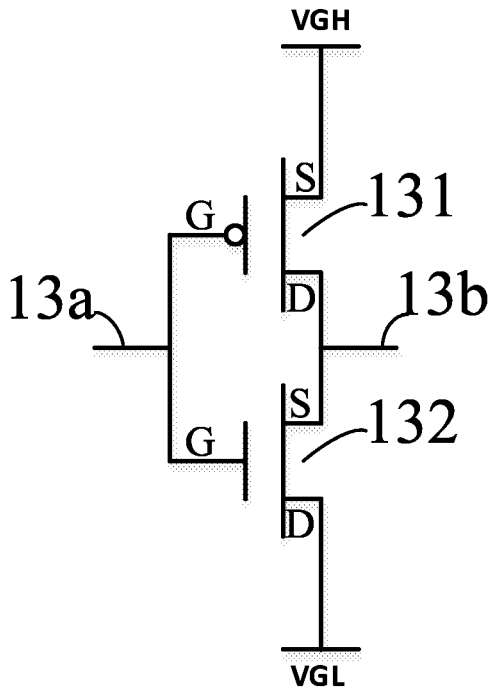
FIG. 5 is an equivalent circuit diagram of a first inverter in the first control latch module as shown in the FIG. 3.

As shown in FIG. 5, FIG. 5 is an equivalent circuit diagram of the first inverter in the first control latch module as shown in the FIG. 3. The first inverter 13 comprises a fourth P-type TFT 131 and a fourth N-type TFT 132. A gate electrode of the fourth P-type TFT 131 is connected with a gate electrode of the fourth N-type TFT 132 to be regarded as an input end 13*a* of the first inverter 13, a drain electrode of the fourth P-type TFT 131 is connected with a source electrode of the fourth N-type TFT 132 to be regarded as an output end 13*b* of the first inverter 13, the constant voltage high level signal (VGH) is input to a source electrode of the fourth P-type TFT 13, and the constant voltage low level signal (VGL) is input to a drain electrode of the fourth N-type TFT 132.

The first inverter 13 is used to invert a high level signal of the input end 13*a* of the first inverter 13 to a low level signal of the input end 13*a* of the first inverter 13 or invert the low level signal of the input end 13*a* of the first inverter 13 to the high level signal of the input end 13*a* of the first inverter 13. Namely, electrical signal of the input end 13*a* of the first inverter 13 are inverted.

In the embodiment, the GOA unit 100*a* further comprises a fourth inverter, where the first clock signal CK1 is input to an input end of the fourth inverter, an output end of the fourth inverter is electrically connected with the second control end 11*d* of the first clock-controlled inverter 11 and the first control end 12*c* of the second clock-controlled inverter 12. The first clock signal CK1 is inverted to the inverted first clock signal XCK1 via the fourth inverter.

It should be understood that structure of other inverters in the embodiment are the same as the structure of the first inverter 13, and the equivalent circuit diagram of other clock-controlled inverters of the embodiment are the same as the equivalent circuit diagram of the FIG. 5.

In the embodiment, the inverted first clock signal XCK1 can be generated by other ways. For example, the odd stages of the GOA units 100*a* and the even stages of the GOA units 100*a* both provide one signal line to output the inverted first clock signal.

The second control latch module 40 comprises a third clock-controlled inverter 41, a fourth clock-controlled inverter 42 and a second inverter 43.

An input end 41*a* of the third clock-controlled inverter 41 is electrically connected with an input end 12*a* of the second clock-controlled inverter 12, an output end 41*b* of the third clock-controlled inverter 41 is electrically connected with an output end 42*b* of the fourth clock-controlled inverter 42 and an input end 43*a* of the second inverter 43, and a third clock signal CK3 and an inverted third clock signal XCK3 are input to a first control end 41*c* and a second control end 41*d* of the third clock-controlled inverter 41, respectively.

An input end 42*a* of the fourth clock-controlled inverter 42 is electrically connected with an output end 43*b* of the second inverter 43 to output the Nth stage cascade signal Q(N), and the inverted third clock signal XCK3 and the third clock signal CK3 are input to a first control end 42*c* and a second control end 42*d* of the fourth clock-controlled inverter 42, respectively.

In the embodiment, the GOA circuit 100*a* further comprises a fifth inverter, where the third clock signal CK3 is input to an input end of the fifth inverter, an output end of the fifth inverter is electrically connected with the second control end 41*d* of the third clock-controlled inverter 41 and the first control end 42*c* of the fourth clock-controlled inverter 42. The third clock signal CK3 is inverted to the inverted third clock signal XCK3 by the fifth inverter.

The signal processing module 20 comprises a first N-type TFT 21, a second N-type TFT 22, a third N-type TFT 23, a first P-type TFT 24, a second P-type TFT 25, a third P-type TFT 26, and a third inverter 27.

A gate electrode of the first N-type TFT 21 and a gate electrode of the first P-type TFT 24 both are electrically connected with the input end 12*a* of the second clock-controlled inverter 12. The constant voltage low level signal VGL is input to a source electrode the first N-type TFT 21 by the second N-type TFT 22, and the constant voltage low level signal VGL is input to a drain electrode of the first N-type TFT 21 by the third N-type TFT 23.

The constant voltage high level signal VGH is input to a source electrode of the first P-type TFT 24 and a source electrode of the second P-type TFT 25 by the third P-type TFT 26. A drain electrode of the first P-type TFT 24 and a drain electrode of the second P-type TFT 25 both are electrically connected with the source electrode of the first N-type TFT 21 at a node A.

A gate electrode of the third N-type TFT 23 and a gate electrode of the second P-type TFT 25 both are electrically connected with an output end 27*b* of the third inverter 27. The second clock signal CK2 is input to an input end 27*a* of the third inverter 27, and a gate electrode of the second N-type TFT 22 is electrically connected with a gate electrode of the third P-type TFT 26 to input a gate control signal (Gas signal).

As shown in FIG. 3, electrical signal at the Node A is the dipulse gate driving signal output by the Nth stage GOA unit 100*a* to improve driving ability of the dipulse gate driving signal at the node A. In the embodiment, the GOA unit 100*a* further comprises an output buffer module 30.

An input end 30*a* of the output buffer module 30 is electrically connected with the signal processing module 20, and an output end 30*b* of the output buffer module 30 is electrically connected with the Nth stage scan line. To be specific, the input end 30*a* of the output buffer module 30 is electrically connected with the node A of the signal processing module 20, namely the input end 30*a* of the output buffer module 30 is electrically connected with the source electrode of the first N-type TFT 21, and the output buffer module 30 is used to output the Nth stage dipulse gate driving signal to the Nth stage scan line 200.

The output buffer module 30 comprises three inverters: a sixth inverter 31, a seventh inverter 31, and an eighth inverter 33. The signal processing module 20 generates the dipulse gate driving signal to output to the Nth stage scan line by the sixth inverter 31, the seventh inverter 32, and the eighth inverter 33 in sequence. The output buffer module 30 is used to improve the driving ability of the dipulse gate driving signal to turn on the sub-pixel connected with the Nth stage scan line 200.

In order to control the GOA circuit 100 to execute the forward scan and the reverse scan, the Nth stage GOA unit 100*a* of the present disclosure further comprises a forward and reverse scan control module 50, where the forward and reverse scan control module 50 is electrically connected with the first control latch module 10.

To be specific, the forward and reverse scan control module 50 comprises a first transmission gate 51 and a second transmission gate 52. An output end of the first transmission gate 51 and an output end of the second transmission gate 52 are both electrically connected with the input end 11*a* of the first clock-controlled inverter 11. Control signals (U2D, D2U) are input to control ends of the first transmission gate 51 and control ends of the second transmission gate 52. The (N−2)th stage cascade signal Q(N−2) is input to an input end of the first transmission gate 51, and The (N+2)th stage cascade signal Q(N+2) is input to an input end of the second transmission gate 52.

Figure 6:
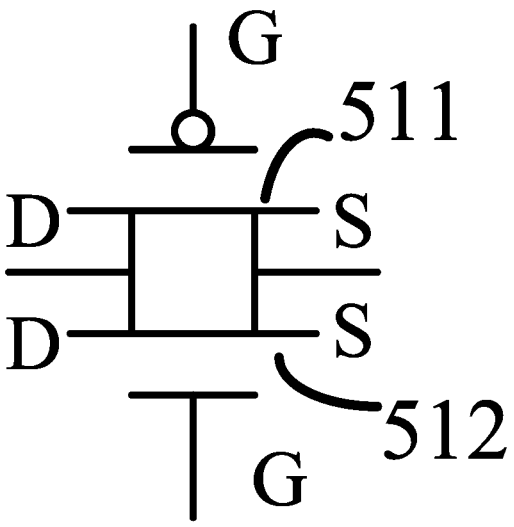
FIG. 6 is an equivalent circuit diagram of a first transmission gate in the forward and reverse scan control module as shown in the FIG. 3.

As shown in FIG. 6, FIG. 6 is an equivalent circuit diagram of the first transmission gate in the forward and reverse scan control as shown in the FIG. 3. The first transmission gate 51 comprises a fifth P-type TFT 511 and a fifth N-type TFT 512. The control signal D2U is input to a gate electrode of the fifth P-type TFT 511, and the control signal U2D is input to a gate electrode of the fifth N-type TFT 512. A drain electrode of the fifth P-type TFT 511 is electrically connected with a drain electrode of the fifth N-type TFT 512 to input the (N−2)th stage gate cascade signal Q(N−2). A source electrode of the fifth P-type TFT 511 and a source electrode of the fifth N-type TFT 512 are electrically connected with the input end 11*a* of the first clock-controlled inverter 11.

It should be understood that the equivalent circuit diagram of the second transmission gate 52 is the same as the equivalent circuit diagram of the first transmission gate 51, combined with FIG. 3 and FIG. 6, to obtain specific connection relationship of the second transmission gate 52, there will not be described.

Based on controlling of the control signals (U2D and D2U), when the first transmission gate 51 turns on and the second transmission gate 52 turns off, the (N−2)th stage gate cascade signal Q(N−2) is input to the first control latch module 10, namely the (N−2)th stage gate cascade signal Q(N−2) is input to the input end 11*a* of the first clock-controlled inverter 11, at this time, the GOA circuit executes the forward scan.

Based on controlling of the control signals (U2D and D2U), when the first transmission gate 51 turns off and the second transmission gate 52 turns on, the (N+2)th stage gate cascade signal Q(N+2) is input to the first control latch module 10, namely the (N−2)th stage gate cascade signal Q(N−2) is input to the input end 11*a* of the first clock-controlled inverter 11, at this time, the GOA circuit executes the reverse scan.

In order to realize reset process at the signal node of the GOA unit 100*a*, in the embodiment, the GOA unit 100*a* further comprises a first reset module 60 and a second reset module 70. The first reset module 60 is electrically connected with the first control latch module 10 to reset the first control latch module 10. The second reset module 70 is electrically connected with the second control latch module 40 to reset the second control latch module 40.

To be specific, the first reset module 60 comprises a sixth P-type TFT 61, where a reset signal (Reset signal) is input to a gate electrode of the sixth P-type TFT 61, the constant voltage high level signal VGH is input to a drain electrode of the sixth P-type TFT 61, and a source electrode of the sixth P-type TFT 61 is electrically connected with the output end 11*b* of the first clock-controlled inverter 11 to reset potential of the output end 11*b* of the first clock-controlled inverter 11.

The second reset module 70 comprises a seventh P-type TFT 71, where the reset signal (Reset signal) is input to a gate electrode of the seventh P-type TFT 71, the constant voltage high level signal VGH is input to a drain electrode of the seventh P-type TFT 71, and a source electrode of the seventh P-type TFT 71 is electrically connected with the output end 41*b* of the third clock-controlled inverter 41 to reset potential of the output end 41*b* of the third clock-controlled inverter 41.

Figure 7:
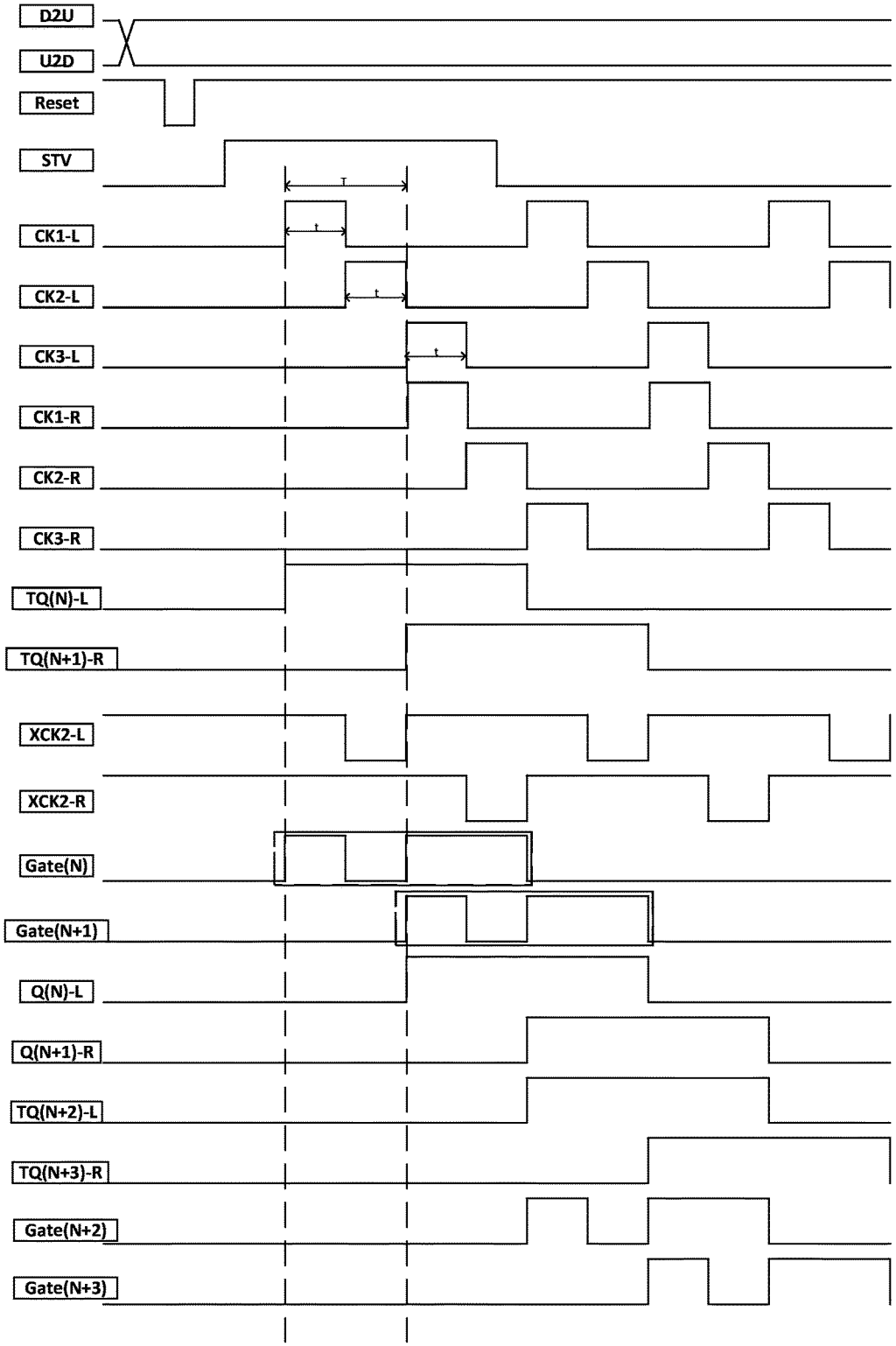
FIG. 7 is a timing diagram of a forward scan of an Nth stage GOA unit and an (N+1)th stage GOA unit according to the embodiment of the present disclosure.

When the GOA circuit of the present disclosure executes the forward scan, as shown in FIG. 7, FIG. 7 is the forward scan timing diagram of an Nth stage GOA unit and an (N+1)th stage GOA unit according to the embodiment of the present disclosure.

When the LCD panel is at working state, namely the LCD panel displays images, the gate control signal (Gas signal) usually keeps a low level signal (logic 0). When the LCD panel executes touch point scanning to insert black image, the gate control signal (Gas signal) is a high level signal (logic 1).

Before the GOA circuit of the present disclosure executes the forward scan, the first reset module 60 and the second reset module 70 reset a corresponding signal node. To be specific, when the reset signal (Reset signal) is changed from a high level (logic 1) to a low level (logic 0), the first reset module 60 and the second reset module 70 both turn on, at this time, the output end 11*b* of the first clock-controlled inverter 11 and the output end 41*b* of the third clock-controlled inverter 41 are at the high level, which are inverted by the first inverter 13 and the second inverter 43, respectively, the input end 12*a* of the second clock-controlled inverter 12 and the input end 42*a* of the fourth clock-controlled inverter 42 are at the low level, namely, the potential of the TQ(N) and Q(N) both are at low level as shown in FIG. 3.

When the Nth stage TQ(N) is at the low level, and the gate control signal (Gas signal) is at the low level signal, the first P-type TFT 24 and third P-type TFT 26 of the signal processing module 20 both turns on, namely the potential of the node A is at the high level. The potential of the node A heighten via the output buffer module 30, the Nth stage gate driving signal Gate(N) is at the low level signal.

Namely, when the reset signal is input, the potential of the nodes of all Q(N) and all Gate(N) are all reset to the low level.

It takes the Nth stage GOA unit 100*a* of a left side of FIG. 2 for example to describe generating processing of the Nth stage dipulse gate driving signal and the Nth stage cascade signal Q(N).

As the GOA circuit executes the forward scan, the control signal D2U is changed from the high level to the low level, and the control signal U2D is changed from the low level to the high level, thus, the first transmission gate 51 turns on and the second transmission gate 52 turns off, the (N−2)th stage cascade signal Q(N−2) is input to the first control latch module 10 by the first transmission gate 51.

When the (N−2)th stage cascade signal Q(N−2) and the first clock signal CK1 at the high level signal simultaneously are input, the (N−2)th stage cascade signal Q(N−2) is inverted by the first clock control signal inverter 11, and the output end 11*b* of the first clock-controlled inverter 11 is at the low level signal.

The low level signal of the output end 11*b* of the first clock-controlled inverter 11 is inverted by the first inverter 13, the input end 12*a* of the second clock-controlled inverter 12 is at the high level, namely the TQ(N) is at the high level.

When the first clock signal CK1 is changed to the low level signal, the second clock-controlled inverter 12 and the first inverter 13 lock the potential of the TQ(N) at the high level.

When the TQ(N) is at the high level, the first N-type TFT 21 turns on. As the second clock signal CK2 is at the low level signal, the second clock signal CK2 is inverted by the third inverter 27, the output end 27*b* of the third inverter 27 is at the high level signal, at this time, the third N-type TFT 23 turns on. The source electrode of the first N-type TFT 21 is at the low level, namely, the node A is at the low level.

The low level of the node A heighten via the output buffer module 30, an output end 30*b* of the output buffer module 30 is at the low level, namely, the Nth stage gate driving signal Gate(N) is at the high level signal.

When a first high level signal of the second clock signal CK2 is input, the second clock signal CK2 is inverted by the third inverter 27, the output end 27*b* of the third inverter 27 is at the low level, the second P-type TFT 25 turns on, the third N-type TFT 23 turn off, at this time, the node A is changed from the low level to the high level. The low level of the node A heighten via the output buffer module 30, the output end 30*b* of the output buffer module 30 is changed from the high level to the low level, namely the Nth stage gate driving signal Gate(N) is changed from the high level signal to the low level. At this time, a first pulse driving signal of the Nth dipulse gate driving signal Gate(N) forms.

When the second clock signal CK2 is changed from the high level to the low level, namely a first high level pulse signal of the second clock signal CK2 ends, the Gate(N) is changed from the low level to the high low level, at this time, a second pulse driving signal of the Nth dipulse gate driving signal Gate(N) forms.

When the first high level pulse signal of the second clock signal CK2 ends, a high level pulse signal of the third clock signal CK3 is input, at this time, the third clock-controlled inverter 41 is at the working state, the output end 41*b* of the third clock-controlled inverter 41 is at the low level.

The low level signal of the output end 41*b* of the third clock-controlled inverter 41 is inverted by the second inverter 43, the input end 42*a* of the fourth clock-controlled inverter 42 is at the high level, namely Q(N) is at the high level. Namely, the Nth stage cascade signal Q(N) forms.

When the third clock signal CK3 is changed from the high level to the low level, namely a first high level pulse signal of the third clock signal CK3 ends, the fourth clock-controlled inverter 42 and the second inverter 43 lock the high level signal of the Nth stage cascade signal Q(N).

When a second high level pulse signal of the first clock signal CK1 is input, as the (N−2)th stage cascade signal Q(N−2) is at the low level signal, the potential of TQ(N) is pulled to the low level because of the (N−2)th stage cascade signal Q(N−2), the first clock signal CK1, and the inverted first clock signal XCK1.

When the first clock signal CK1 is changed from the high level to the low level again, namely a second high level pulse signal of the first clock signal CK1 ends, the second clock-controlled inverter 12 and the first inverter 13 locks the potential of TQ(N) at the low level As the potential of TQ(N) is locked at the low level, the first P-type TFT 24 turns on, and the potential of the node A is changed to the high level.

The high level signal at the node A heightens via the output buffer module 30, the potential of the output end 30*b* of the output buffer module 30 is changed to the low level, namely a second pulse driving signal of the Nth dipulse gate driving signal Gate(N) forms.

The second high level pulse signal of the third clock signal CK3 is input, the TQ(N) is at the low level, the third clock signal CK3 and the inverted third clock signal XCK3 control the second control latch module 40 to turn on, which pulls the potential of the Nth stage cascade signal Q(N) to the low level, namely the Nth stage cascade signal Q(N) forms. When the second high level pulse signal of the third clock signal CK3 ends, the Nth stage cascade signal Q(N) is locked at the low level.

According to the above description that the Nth stage GOA unit 100*a* of the left side of FIG. 2 generates the Nth stage dipulse gate driving signal Gate(N) and the Nth stage cascade signal Q(N), it is easy to obtain the processing that (N+1)th stage GOA unit 100*a* generates the (N+1)th stage dipulse gate driving signal Gate(N+1) and the (N+1)th stage cascade signal Q(N+1), as shown in FIG. 7.

In the embodiment, for the clock signals corresponding to adjacent two stages of the GOA units 100*a*, a first clock signal is delay for predetermined period of time T with respect to a second clock signal. For example, in the embodiment, as shown in FIG. 7, clock pulses widths (t) of the first clock signal CK1, the second clock signal CK2, and the third clock signal CK3 are all the same, and the predetermined period of time T is twice as much as the clock pulse width (t). When the GOA circuit executes the forward scan, the clock signal corresponding to the (N+1)th GOA unit is delayed for a predetermined period of time T with respect to the clock signal corresponding to the Nth GOA unit, in a similar way, the clock signal corresponding to the (N+2)th GOA unit is delayed for a predetermined period of time T with respect to the clock signal corresponding to the (N+1)th GOA unit, and so on.

Two dipulse gate driving signal generated by the adjacent two stages of the GOA units 100*a* partially overlap. For example, as shown in FIG. 7, the first pulse driving signal of the (N+1) stage dipulse gate driving signal and the second pulse driving signal of the Nth dipulse gate driving signal are simultaneously generated (namely overlap).

In addition, the clock pulses widths of the first clock signal CK1, the second clock signal CK2, and the third clock signal CK3 are all the same, and the first clock signal CK1, the second clock signal CK2, and the third clock signal CK3 appear in sequence. Thus, pulse width of the second pulse driving signal is twice as much as pulse width of the first pulse driving signal in the dipulse gate driving signal.

As shown in FIG. 1 and FIG. 7, when the first pulse driving signal of the (N+1)th stage dipulse gate driving signal generates, the second pulse driving signal of the Nth stage dipulse gate driving signal generates. Namely, at this time, the Nth stage and the (N+1) stage scan lines 200 both are in a charged state, and TFTs of the first sub-pixel 410 and the second sub-pixel 420 connected with the Nth stage and the (N+1) stage scan lines 200 both turn on. The Nth stage first sub-pixel 410 is charged by the second sub-pixel 420 through (M+2)th data line 300.

Namely, one sub-pixel unit 400 is charged by one data line 300 under matching with the dipulse gate driving signal of the adjacent two stages of the scan lines 200.

Figure 8:
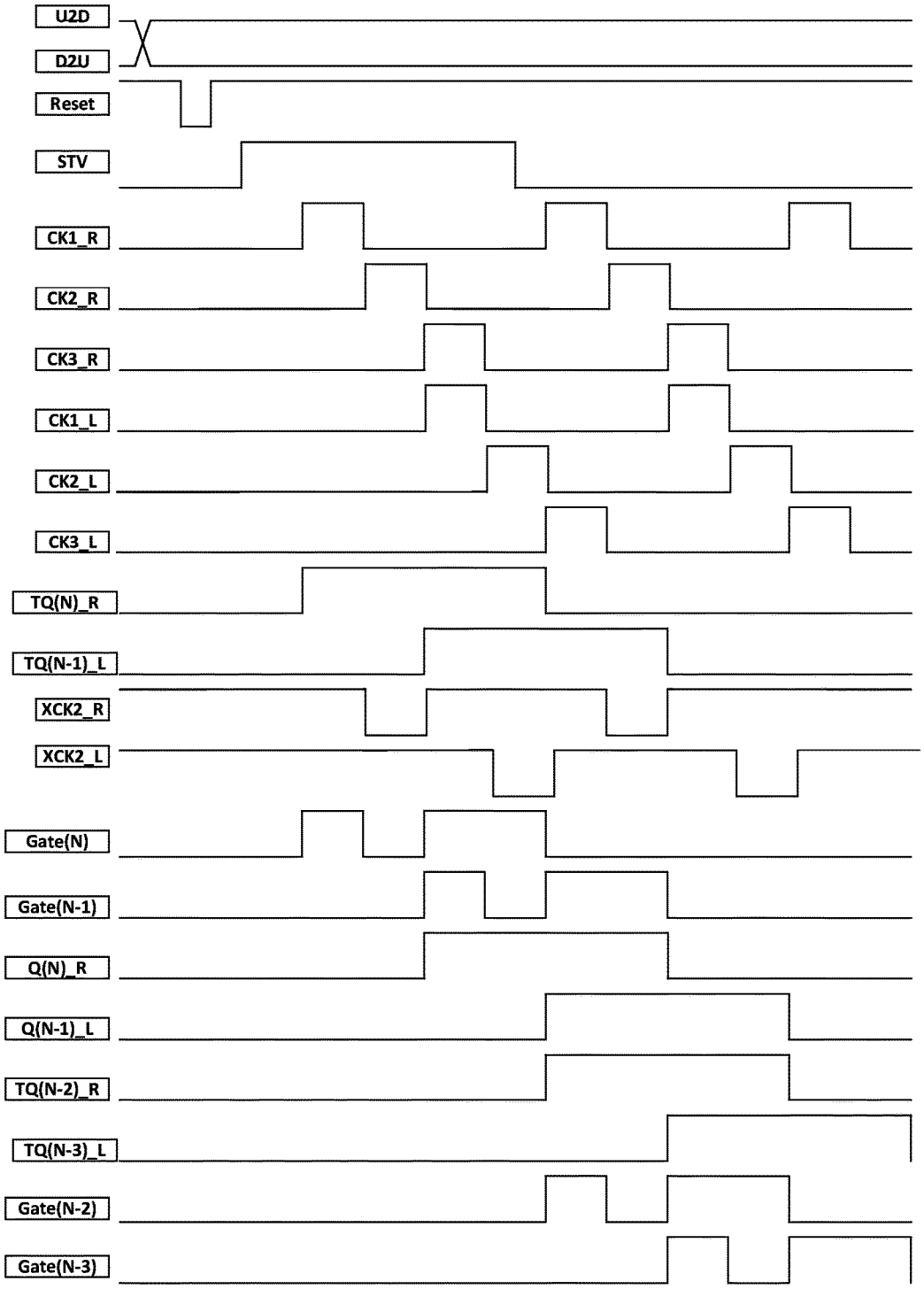
FIG. 8 is a timing diagram of a reverse scan of the Nth stage GOA unit and the (N−1)th stage GOA unit according to the embodiment of the present disclosure.

It should be understood, the GOA circuit 100 of the present disclosure also executes the reverse scan, as shown in FIG. 8, FIG. 8 is a reverse scan timing diagram of an Nth stage GOA unit and an (N−1)th stage GOA unit according to the embodiment of the present disclosure. When the GOA circuit 100 executes the reverse scan, based on controlling of the control signals (U2D and D2U), the second transmission gate 52 turns on and the first transmission gate 51 turns off, namely the (N+2)th stage gate cascade signal Q(N+2) is input to the Nth stage first control latch module 10 by the second transmission gate 52. As a processing of the reverse scan is similar with a processing of the forward scan, according to the above description of the forward scan, it is easy to obtain the processing of the reverse scan for people in the art, there will not be described.

The GOA circuit of the present disclosure can generate the dipulse gate driving signal and the dipulse gate driving signals of the adjacent two stages of the GOA unit partially overlap. The dipulse gate driving signals are input to the adjacent two stages of the scan line in sequence to simultaneously turn on two TFTs of the adjacent two sub-pixels, and the two sub-pixels are charged by one data line.

As the above, it should be understood that the present disclosure has been described with reference to certain preferred and alternative embodiments which are intended to be exemplary only and do not limit the full scope of the present disclosure as set forth in the appended claims.

What is claimed is:

1. A gate driver on array (GOA) circuit, comprising:

a plurality of stages of GOA units cascaded;

wherein odd stages of the GOA units are cascaded, and even stages of the GOA units are cascaded; an Nth stage GOA unit comprises a first control latch module, a signal processing module, and a second control latch module, and N is a positive integer;

wherein the first control latch module is electrically connected with the second control latch module and the signal processing module; the first control latch module, the signal processing module, and the second control latch module generate an Nth stage dipulse gate driving signal and an Nth stage cascade signal according to clock signals, and an (N−2)th or (N+2)th stage cascade signal;

for clock signals corresponding to adjacent two-stages of the GOA units, a first clock signal is delayed a predetermined period of time with respect to a second clock signal, and two dipulse gate driving signals generated by the adjacent two-stages of the GOA units partially overlap;

wherein the clock signal comprises a first clock signal, a second clock signal, and a third clock signal;

wherein the dipulse gate driving signal comprises a first pulse driving signal and a second pulse driving signal; a pulse width of the second pulse driving signal is twice as much as a pulse width of the first pulse driving signal;

wherein clock pulse widths of the first clock signal, the second clock signal, and the third clock signal are all same; the predetermined period of time is twice as much as the clock pulse width, and the first pulse driving signal of a first dipulse gate driving signal and the second pulse driving signal of a second dipulse gate driving signal are simultaneously generated in the two dipulse gate driving signals generated by the adjacent two stages of the GOA units;

wherein the first control latch module comprises a first clock-controlled inverter, a second clock-controlled inverter, and a first inverter;

wherein the (N−2)th or (N+2)th stage cascade signal is input to an input end of the first clock-controlled inverter, an output end of the first clock-controlled inverter is electrically connected with an output end of the second clock-controlled inverter and an input end of the first inverter, and the first clock signal and an inverted first clock signal are input to a first control end and a second control end of the first clock-controlled inverter, respectively; and wherein an input end of the second clock-controlled inverter is electrically connected with an output end of the first inverter, the second control latch module is electrically connected with the signal processing module; the inverted first clock signal and the first clock signal are input to a first control end and a second control end of the second clock-controlled inverter, respectively.

2. The GOA circuit as claimed in claim 1, wherein the second control latch module comprises a third clock-controlled inverter, a fourth clock-controlled inverter and a second inverter;

wherein an input end of the third clock-controlled inverter is electrically connected with an input end of the second clock-controlled inverter, an output end of the third clock-controlled inverter is electrically connected with an output end of the fourth clock-controlled inverter and an input end of the second inverter, and a third clock signal and an inverted third clock signal are input to a first control end and a second control end of the third clock-controlled inverter, respectively;

wherein an input end of the fourth clock-controlled inverter is electrically connected with an output end of the second inverter to output the Nth stage cascade signal, and the inverted third clock signal and the third clock signal are input to a first control end and a second control end of the fourth clock-controlled inverter, respectively.

3. The GOA circuit as claimed in claim 2, wherein the signal processing module comprises a first N-type thin film transistor (TFT), a second N-type TFT, a third N-type TFT, a first P-type TFT, a second P-type TFT, a third P-type TFT, and a third inverter;

wherein a gate electrode of the first N-type TFT and a gate electrode of the first P-type TFT are both electrically connected with the input end of the second clock-controlled inverter; a constant voltage low level signal is input to a source electrode the first N-type TFT by the second N-type TFT, and the constant voltage low level signal VGL is input to a drain electrode of the first N-type TFT by the third N-type TFT; a source electrode of the first N-type TFT outputs the Nth stage dipulse gate driving signal;

wherein a constant voltage low level signal is input to a source electrode of the first P-type TFT and a source electrode of the second P-type TFT by the third P-type TFT; a drain electrode of the first P-type TFT and a drain electrode of the second P-type TFT are both electrically connected with the source electrode of the first N-type TFT;

wherein a gate electrode of the third N-type TFT and a gate electrode of the second P-type TFT are both electrically connected with an output end of the third inverter; the second clock signal is input to an input end of the third inverter, and a gate electrode of the second N-type TFT is electrically connected with a gate electrode of the third P-type TFT to input a gate control signal.

4. The GOA circuit as claimed in claim 3, wherein the Nth stage GOA unit further comprises an output buffer module; wherein an input end of the output buffer module is electrically connected with the source electrode of the first N-type TFT, and an output end of the output buffer module is electrically connected with the Nth stage scan line to output the Nth stage dipulse gate driving signal to the Nth stage scan line.

5. The GOA circuit as claimed in claim 4, wherein the Nth stage GOA unit further comprises a forward and reverse scan control module; the forward and reverse scan control module is electrically connected with the first control latch module to control the (N−2)th or (N+2)th stage cascade signal to input to the first control latch module.

6. The GOA circuit as claimed in claim 4, wherein the GOA unit further comprises a first reset module and a second reset module; the first reset module is electrically connected with the first control latch module to reset the first control latch module; the second reset module is electrically connected with the second control latch module to reset the second control latch module.

7. The GOA circuit as claimed in claim 3, wherein the Nth stage GOA unit further comprises a forward and reverse scan control module; the forward and reverse scan control module is electrically connected with the first control latch module to control the (N−2)th or (N+2)th stage cascade signal to input to the first control latch module.

8. The GOA circuit as claimed in claim 3, wherein the GOA unit further comprises a first reset module and a second reset module; the first reset module is electrically connected with the first control latch module to reset the first control latch module; the second reset module is electrically connected with the second control latch module to reset the second control latch module.

9. The GOA circuit as claimed in claim 2, wherein the Nth stage GOA unit further comprises a forward and reverse scan control module; the forward and reverse scan control module is electrically connected with the first control latch module to control the (N−2)th or (N+2)th stage cascade signal to input to the first control latch module.

10. The GOA circuit as claimed in claim 2, wherein the GOA unit further comprises a first reset module and a second reset module; the first reset module is electrically connected with the first control latch module to reset the first control latch module; the second reset module is electrically connected with the second control latch module to reset the second control latch module.

11. The GOA circuit as claimed in claim 1, wherein the Nth stage GOA unit further comprises a forward and reverse scan control module; the forward and reverse scan control module is electrically connected with the first control latch module to control the (N−2)th or (N+2)th stage cascade signal to input to the first control latch module.

12. The GOA circuit as claimed in claim 1, wherein the GOA unit further comprises a first reset module and a second reset module; the first reset module is electrically connected with the first control latch module to reset the first control latch module; the second reset module is electrically connected with the second control latch module to reset the second control latch module.

13. A liquid crystal display (LCD) panel, comprising:

a plurality of scan lines, a plurality of data lines, a plurality of sub-pixel units defined by the plurality of the scan lines crossing the plurality of the data lines, and a gate driver on array (GOA) circuit providing dipulse gate driving signal for the scan lines;

wherein the GOA circuit comprises the GOA circuit comprising a plurality of stages of GOA units cascaded, wherein odd stages of the GOA units are cascaded, and even stages of the GOA units are cascaded; an Nth stage GOA unit comprises a first control latch module, a signal processing module, and a second control latch module, and N is a positive integer;

wherein the first control latch module is electrically connected with the second control latch module and the signal processing module; the first control latch module, the signal processing module, and the second control latch module generate an Nth stage dipulse gate driving signal and an Nth stage cascade signal according to clock signals, and an (N−2)th or (N+2)th stage cascade signal;

for clock signals corresponding to adjacent two-stages of the GOA units, a first clock signal is delayed a predetermined period of time with respect to a second clock signal, and two dipulse gate driving signals generated by the adjacent two-stages of the GOA units partially overlap;

wherein the clock signal comprises a first clock signal, a second clock signal, and a third clock signal;

wherein the dipulse gate driving signal comprises a first pulse driving signal and a second pulse driving signal; a pulse width of the second pulse driving signal is twice as much as a pulse width of the first pulse driving signal;

wherein clock pulse widths of the first clock signal, the second clock signal, and the third clock signal are all same; the predetermined period of time is twice as much as the clock pulse width, and the first pulse driving signal of a first dipulse gate driving signal and the second pulse driving signal of a second dipulse gate driving signal are simultaneously generated in the two dipulse gate driving signals generated by the adjacent two stages of the GOA units;

wherein the first control latch module comprises a first clock-controlled inverter, a second clock-controlled inverter, and a first inverter;

wherein the (N−2)th or (N+2)th stage cascade signal is input to an input end of the first clock-controlled inverter, an output end of the first clock-controlled inverter is electrically connected with an output end of the second clock-controlled inverter and an input end of the first inverter, and the first clock signal and an inverted first clock signal are input to a first control end and a second control end of the first clock-controlled inverter, respectively; and wherein an input end of the second clock-controlled inverter is electrically connected with an output end of the first inverter, the second control latch module is electrically connected with the signal processing module; the inverted first clock signal and the first clock signal are input to a first control end and a second control end of the second clock-controlled inverter, respectively;

the sub-pixel unit comprises a first sub-pixel and a second sub-pixel; the first sub-pixel and the second sub-pixel are charged by same data line under controlling of the dipulse gate driving signal in the adjacent two stages of the scan line.

* * * * *